United States Patent [19]

Stauffer

[11] 4,290,226

[45] Sep. 22, 1981

[54] FLEXIBLE FLYING DISC TOY

[76] Inventor: Allen R. Stauffer, 860 Normandy Dr., Suffolk, Va. 23434

[21] Appl. No.: 94,495

[22] Filed: Nov. 15, 1979

[51] Int. Cl.[3] ..... A63H 27/00

[52] U.S. Cl. ..... 46/74 D; 273/424

[58] Field of Search ..... 46/74 D, 1 F; 273/424, 273/425

[56] References Cited

U.S. PATENT DOCUMENTS

| | | | |
|---|---|---|---|
| 1,292,011 | 1/1919 | Monroe | 273/424 |
| 2,864,201 | 12/1958 | Leise | 273/424 X |
| 4,115,946 | 9/1978 | Vukmirovich | 273/424 X |
| 4,201,009 | 5/1980 | Burridge, Jr. | 46/1 F |
| 4,223,473 | 9/1980 | Brown | 46/74 D |

*Primary Examiner*—Gene Mancene
*Assistant Examiner*—Mickey Yu
*Attorney, Agent, or Firm*—Le Blanc, Nolan, Shur & Nies

[57] ABSTRACT

A flexible flying disc toy having a flat, flexible body of fabric material, whereby an advertising message or the like may be printed thereon, and a shape defining and retaining, flexible peripheral ring and rim integrally formed of vinyl or the like so that the disc toy may be folded or crumpled for storage, the toy assuming its original shape after storage and before use.

6 Claims, 4 Drawing Figures

Fig 1.
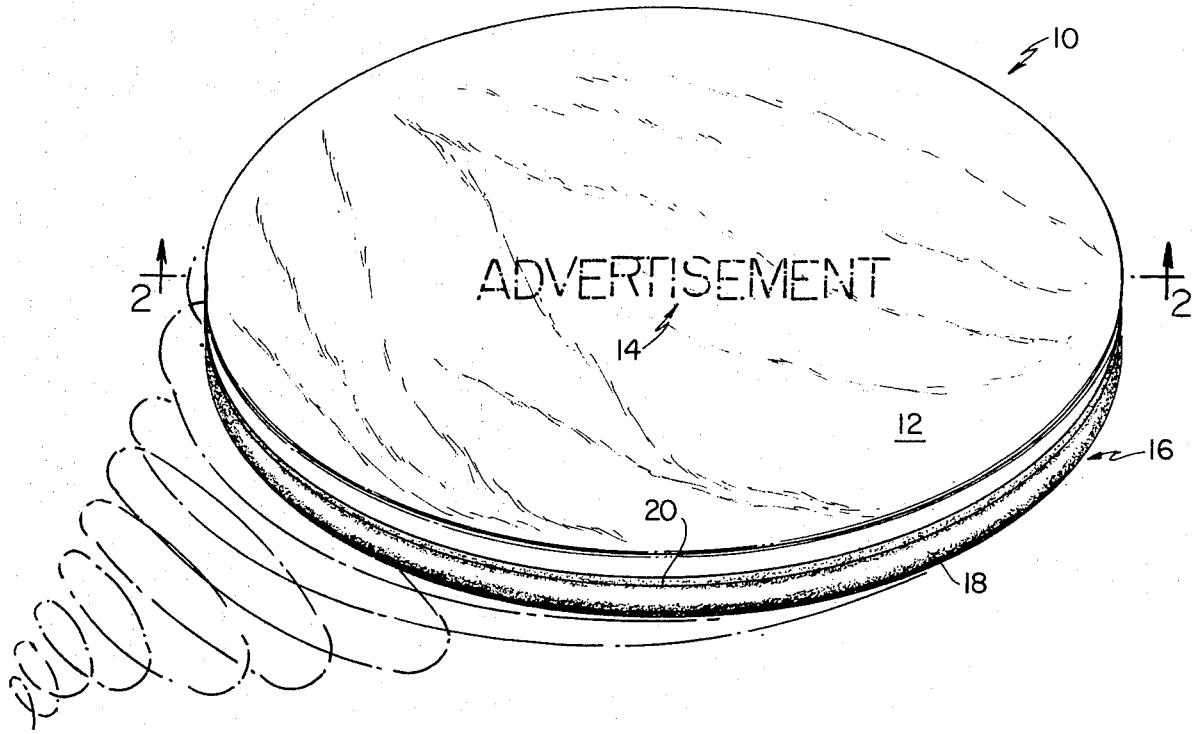
Fig 2.
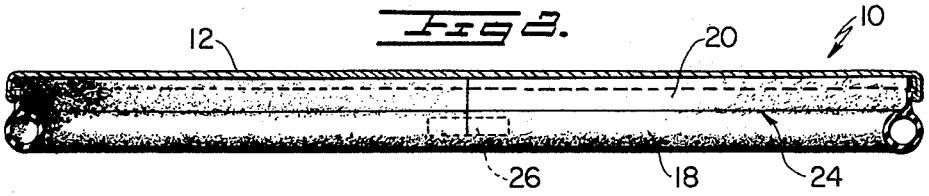
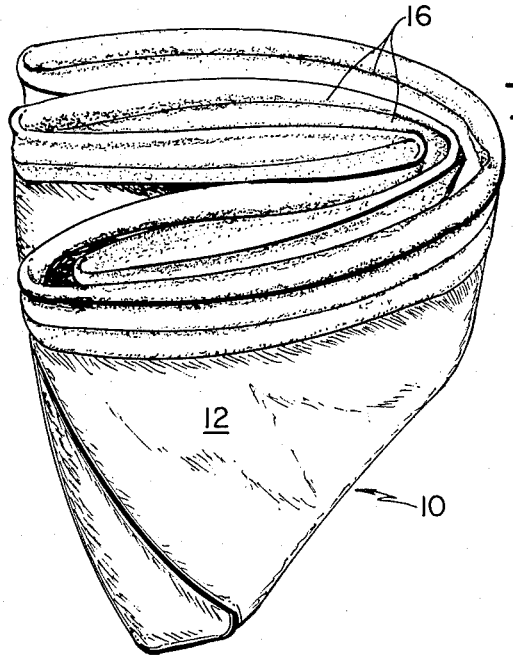
Fig 4
Fig 3.
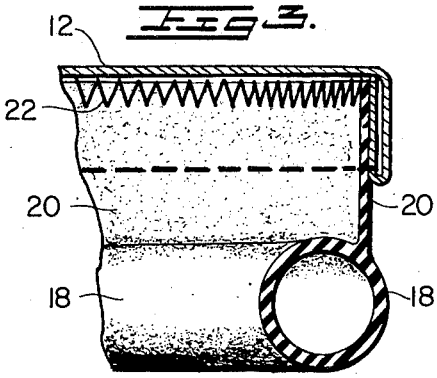

FLEXIBLE FLYING DISC TOY

BACKGROUND OF THE INVENTION

This invention relates generally to circular disc toys exhibiting stable aerodynamic properties when tossed or thrown and more particularly to an improved flexible disc toy which may be folded or crumpled when not in use.

A most popular flying disc or saucer toy is the well known "Frisbee" manufactured by the Wham-O Manufacturing Company of San Gabriel, Calif. and disclosed and claimed in U.S. Pat. No. 3,359,678 issued to Edward E. Headrick on Dec. 26, 1967. This disc is made of a relatively rigid plastics material having a recessed undersurface so that, when tossed in the air, the disc flies in a rotating aerodynamically stable manner. While this toy is most suitable for outdoor use, it is not very practical for indoor use in the presence of lamps, vases, pictures and similar items of relatively delicate structure which might not survive the impact of a thrown, high speed plastic saucer, without suffering considerable damage.

It has been recognized that a "Frisbee" type of toy could be made of softer materials so that children (and even adults) could use the toy indoors. A flying saucer made of a flexible, resilient polyurethane foam, formed to have a recessed undersurface for stable flight is disclosed in U.S. Pat. No. 3,710,505 issued to Carl J. Linenfelser on Jan. 16, 1973. This toy is obviously not readily folded for storage nor could an advertising message or the like be readily imprinted on the surface thereof.

A more recent development, and a truly flexible flying disc or saucer which may double as a hat, is disclosed in U.S. Pat. No. 4,115,946, issued to Daniel Vukmirovich on Sept. 26, 1978. The disc toy or cap disclosed therein is currently marketed as the "Flippy Flier" and is formed as a non-shape retaining disc of cloth having a downturned, gathered edge, hemmed to receive evenly distributed weights or a single weight, the device being easily crumpled and folded for storage when not being used as a cap or flying toy. However, the requirement for weights in the device leaves it obviously somewhat undesirable for use indoors.

In direct contradistinction to the Vukmirovich, flexible flying disc, the present invention provides a truly flexible flying disc or saucer which is easily folded and crumpled for storage, yet is made of components having sufficient elastic memory so that the disc returns to its original configuration for use as a flying toy.

SUMMARY OF THE INVENTION

Accordingly, it is a principal object of the invention to provide a flexible, flying disc or saucer toy which may be folded for storage and which will assume its original shape for use after storage.

It is another object of the invention to provide a flexible flying disc toy having a fabric or similar material body and a surrounding ring structure attached to the periphery of the body, the ring being made of plastics material having sufficient elastic memory to return the disc to its original configuration after the disc has been crumpled and folded for storage, the fabric body being readily imprintable with an advertising message or the like, if desired.

It is a further object of the invention to provide a flexible, flying disc toy which is completely safe for use indoors, even in the presence of relatively easily broken items such as vases, lamps and the like.

In general, the flexible flying disc of this invention includes a disc, fabric body which is easily imprinted with a message or the like, and a peripheral, depending, integral rim and ring structure, the fabric body being sewn or otherwise attached to the rim. The one-piece rim and ring may be made from a strip supply of such material which is cut to a predetermined length. Thereafter, the ends of the strip are secured together by a plug or are glued or heat welded in a known manner. The integral rim and ring are made of vinyl plastic or similar material having sufficient elastic memory to return the disc to its initial configuration after the disc is folded and even crumpled for storage (e.g., in one's pocket).

BRIEF DESCRIPTION OF THE DRAWINGS

Further objects and advantages of the present invention will become readily apparent by reference to the following detailed specification and drawings depicting a preferred embodiment of the invention.

FIG. 1 is a perspective view of the invention;

FIG. 2 is a section view, taken along lines 2—2 of FIG. 1;

FIG. 3 is a detail view taken from the right side of FIG. 2 and drawn to an enlarged scale; and FIG. 4 shows the invention folded for storage.

DESCRIPTION OF THE PREFERRED EMBODIMENT

Referring now to the drawings by reference character, a flexible flying disc or saucer 10 is shown, which includes a disc body 12 made of flexible sheet material, preferably a woven fabric such as cotton polyester. Such material may be readily imprinted with an advertising message or logo, symbol, etc., as indicated at 14. The imprinting may be accomplished by a conventional silk screen process or a design could even be woven into body 12 if desired.

An integral ring and rim 16 are provided about the periphery of disc body 12. The ring and rim 16 include a ring 18 in the form of a hollow tubular annulus and an upstanding rim 20. Body 12 is attached or sewn to rim 20 by stitching 22 or by any one of a number of conventional methods. The complete product thus defines a disc having suitable aerodynamic properties for stable flight through the air in that a recess 24 is thereby defined in the undersurface of disc 10.

Ring and rim 16 may be made from an elongate strip of material which is cut to a predetermined length. The ends thereof are then brought together and a plastic plug 26 is inserted into the tube ends as shown to complete the ring and rim structure. Alternatively, the ends could be glued or heat welded together in a conventional manner to form the completed ring and rim 16. Thereafter, body 12 (which with a desired message 14) is sewn to rim 20 to complete the disc.

Ring and rim 16 are made of a plastics material such as vinyl which possesses sufficient elastic memory to return to its original, circular configuration after being folded and crumpled for storage (e.g., stuffed into one's pocket). The material need only be shape retaining enough so as to lightly stretch body 12 into its original configuration. It has been found that vinyl is quite suitable and will meet the requirements just described even after repeated folding and crumpling.

The completed disc 10 is about eight inches in diameter and extremely light in weight (i.e., no more than a few ounces) with no band surfaces or weights built in. Thus, the disc may be safely tossed about indoors without fear of damaging rather delicate items such as vases, lamps, etc. Of course it may be used outdoors as well.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A flying disc or saucer toy having aerodynamic properties so that, when tossed and simultaneously rotated, said toy will fly in a stable manner, said toy comprising: a flat, circular body portion of flexible sheet material; a flexible ring attached to the periphery of said circular body portion, said ring being made of plastics material having sufficient elastic memory to be shape retaining and stretch said body portion into a disc shaped configuration yet pliable so that said toy may be folded and/or crumpled for storage; and an integral upstanding, circumferential rim on said ring, said body portion being attached to said rim whereby said disc toy assumes an unfolded shape with a flat, upper surface and a recessed undersurface to thus exhibit stable, aerodynamic properties when tossed or thrown.

2. The flexible disc toy as claimed in claim 1 wherein said body is made of a fabric whereby an advertising or like message may be readily imprinted thereon as by silk screening or other processes.

3. The flying disc toy as claimed in claim 1 wherein said body portion is sewn to said rim.

4. The flying disc toy as claimed in claim 1 wherein said ring is formed as an annular tube.

5. The flying disc toy as claimed in claim 4 wherein said ring and rim are made from an elongate strip of vinyl material which is cut to a predetermined length, a plug being provided to secure the open tube ends of said ring together to thus form said ring and rim.

6. The flying disc toy as claimed in claim 1 wherein said ring and rim are made from an elongate strip of vinyl material which is cut to a predetermined length, the ends thereof being glued or heat welded together to thus form said ring and rim.

* * * * *